United States Patent [19]

Loose

[11] Patent Number: 4,637,675

[45] Date of Patent: Jan. 20, 1987

[54] INSULATION DISPLACING BARREL TERMINAL

[75] Inventor: Winfield W. Loose, Harrisburg, Pa.

[73] Assignee: AMP Incorporated, Harrisburg, Pa.

[21] Appl. No.: 810,800

[22] Filed: Dec. 19, 1985

Related U.S. Application Data

[63] Continuation-in-part of Ser. No. 672,554, Nov. 19, 1984.

[51] Int. Cl.[4] ..... H01R 4/24

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 4,283,105 | 8/1981 | Ferrill et al. | 339/97 R |
| 4,431,247 | 2/1984 | Abdullah et al. | 339/97 P |
| 4,575,173 | 3/1986 | Chapin et al. | 339/97 R |

*Primary Examiner*—Joseph H. McGlynn

*Attorney, Agent, or Firm*—Eric J. Groen

[57] ABSTRACT

A barrel-shaped terminal has two spiraled walls forming a cylinder of double thickness material. The terminal has a wire receiving opening in communication with a wire-receiving slot running around the circumference of the cylinder. Placing a wire in a wire receiving opening and rotating the wire with respect to the axis of the cylinder, terminates the conductor of the wire in the wire receiving slot.

8 Claims, 19 Drawing Figures

INSULATION DISPLACING BARREL TERMINAL

This application is a continuation-in-part application of pending application Ser. No. 672,554 filed Nov. 19, 1984.

BACKGROUND OF THE INVENTION

1. Field of the Invention

The invention relates to an insulation displacement terminal utilizing a wire receiving opening in line with a longitudinal wire slot. Placing a wire in the wire receiving opening and rotating the wire relative to the terminal, terminates the wire in the wire receiving slot.

2. Description of the Prior Art

There are many instances where terminal blocks are set up in high density arrays. Many of these terminal blocks are simply threaded members fixed with insulation material which receive wires either wrapped around the threaded members and secured thereto by an application of a nut or the wires are terminated by known spade or ring terminals and then secured to the threaded member by a nut. While these have, in some instances, provided effective means for termination, they have not always been convenient for maintenance or repair and they frequently are subjected to environmental degradation with a resulting loss of desired electrical characteristics.

There is a need, predominantly within the telecommunications industry for reusable terminals, and terminals which can accommodate more than one conductor size. The telephone wires coming from the phone company can either be in the form of buried cable or aerial wires. The high density arrays would be mounted in either an enclosure on the aerial mount or on an enclosed pedestal affixed to the ground. As new telephones are installed in a selected locality, the phone wires are then terminated to the respective terminals on the high density array. The wire sizes within the industry are not always the same gauge and therefore the terminals must be designed to accommodate more than one wire size. A typical size wire running from the high density array to the phone installation is steel wire with a gauge of 18½ AWG, although, other phone installations use copper wire having a gauge of 23 AWG. It can be appreciated then, that a terminal having a higher quality means for terminating conductors and having means to accommodate more than one wire size, would be a substantial improvement within the industry. U.S. Pat. No. 4,431,247 shows an insulated terminal and module, however the shell of the terminal is single thickness of stamping and it also utilizes a one-wire opening for insulation displacement.

SUMMARY OF THE INVENTION

The present invention utilizes insulation displacement technology to enable termination of a number of wire sizes with the termination being reusable and requiring only a common tool. The present invention, which can have a wide variety of configurations where special applications are required, consists of a barrel-shaped metal termination member which has at least one wire receiving hole with an adjacent longitudinal slot extending about the circumference of the barrel. Although not part of this invention, the wire is terminated by means of a wire termination tool. When the tool is placed over the terminal and the wire is placed in the wire-receiving slot and the tool and wire are simultaneously rotated with respect to the barrel terminal, the wire is terminated in the wire-receiving slot. The tool can then be removed and used on several other terminals in the same array.

DESCRIPTION OF THE PREFERRED EMBODIMENTS

Figure 1:
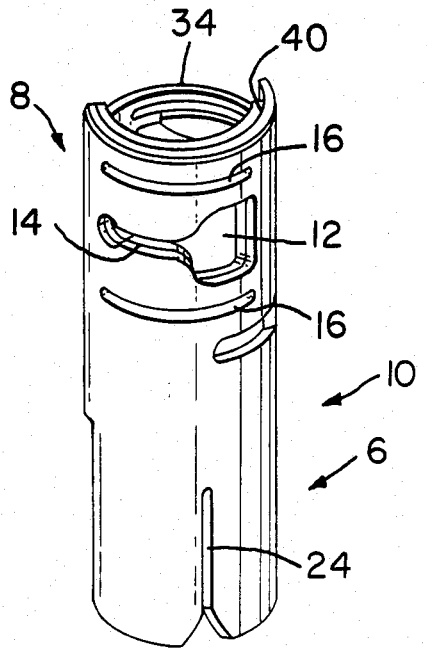
FIG. 1 is a perspective view of the barrel terminal showing the large wire-receiving opening.
Figure 2:
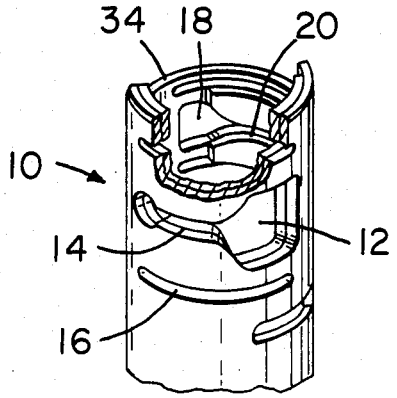
FIG. 2 is a perspective view similar to that of FIG. 1, partially cut away to show the small wire-receiving opening.

The subject invention is a cylindrically shaped insulation displacement terminal including a large wire-receiving opening 12 and large wire-receiving slot 14, as shown in FIG. 1. It also includes small wire-receiving opening 18 and small wire-receiving slot 20 as shown in FIG. 2. It further comprises lower insulation displacement slots 24.

Figure 3:
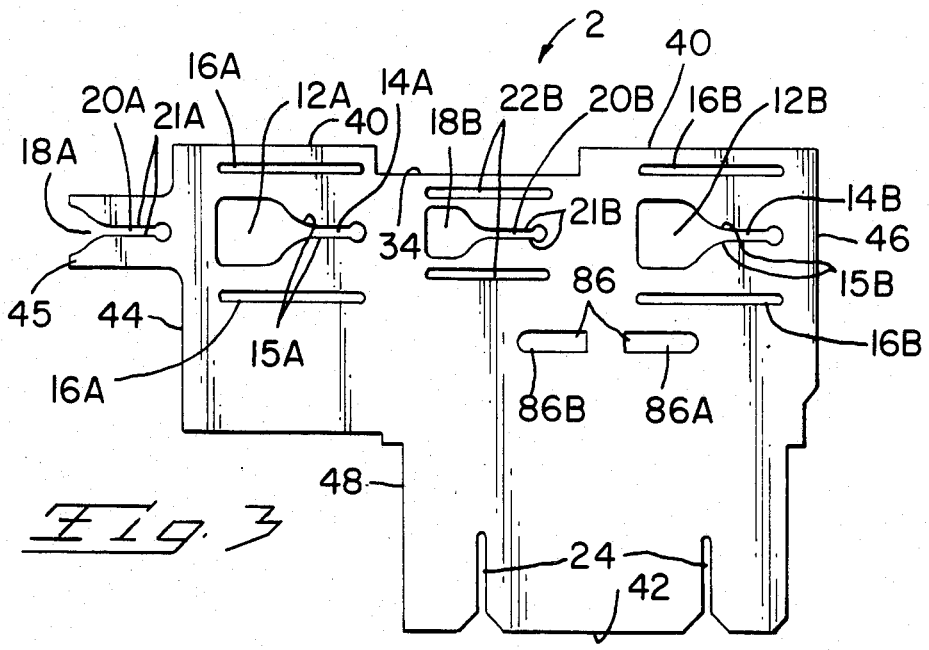
FIG. 3 is a stamped blank prior to being rolled into a barrel terminal.

The subject terminal begins as a blank 2, as shown in FIG. 3, which has been stamped from a metal having good conductive qualities; good conductive qualities are required because two signal-carrying wires are terminated to the terminal and the signal is carried through the body of the terminal.

As stamped, the blank 2 has top bearing surfaces 34 and 40, forward surface 44, a tab 45 on forward surface 44, a bottom surface 42 and a recessed surface 48. The blank 2 includes an inner small wire opening 18A in tab 45, the opening 18A being in transition with an inner small wire receiving slot 20A defined by sheared surfaces 21A. The blank 2 includes an inner large wire-receiving opening 12A in transition with an inner large wire-receiving slot 14A defined by sheared surfaces 15A, and strain relief slots 16A above and below the large wire opening 12A and large wire slot 14A. The blank 2 includes outer small wire-receiving opening 18B in transition with outer small wire-receiving slot 20B defined by sheared surfaces 21B, and strain relief slots 22B above and below opening 18B and slot 20B. The blank 2 includes an outer large wire-receiving opening 12B in transition with an outer large wire receiving slot 14B defined by sheared surfaces 15B, and strain relief slots 16B above and below the opening 12B and slot 14B. The blank 2 further includes lower insulation displacement slots 24.

Figure 5:
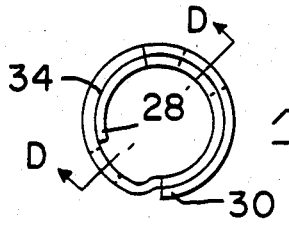
FIG. 5 is a top view of the barrel insulation displacement terminal.
Figure 4:
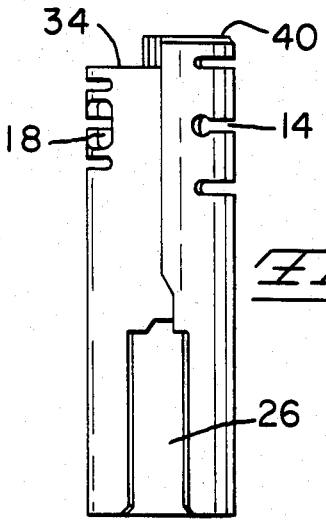
FIG. 4 is a side view of the barrel insulation displacement terminal.

The terminal is then formed by rolling the stamped blank 2 into a cylindrical configuration comprising a spiraled double wall thickness, as shown in FIG. 5. As best shown in FIGS. 3 and 5, the spiral begins with the end having the inner small wire-receiving opening 18A. The spiral is then rolled clockwise around the end having the inner small wire-receiving opening 18A until the outer small wire-receiving opening 18B overlaps the small inner wire receiving opening 18A, and continues around until the large outer wire-receiving opening 12B overlaps the large inner wire-receiving opening 12A. As overlapped, the outer large wire strain relief slots 16B also overlap the large strain relief slots 16A.

It is envisioned that several terminals as described are placed in a high density array and that several wires will be terminated to the respective terminals. One wire to be terminated is placed in the lower insulation displacement slot 24 and a conventional stuffer (not shown) is used to terminate the conductor in the lower insulation displacement slot 24. The second wire, a large or small wire is then selected to be interconnected to the first wire, which has already been terminated in the lower insulation displacement slot 24. Termination of the second wire will then be accomplished by first placing the terminating tool of FIG. 8 over the terminal 10 and then placing either the large or small wire in the wire-receiving opening 354, and then rotating the wire with respect to the axial direction of the cylindrical terminal. Rotation of a wire urges the wire into a wire-receiving slot and displaces the insulation and terminates a conductor within a slot.

Figure 8:
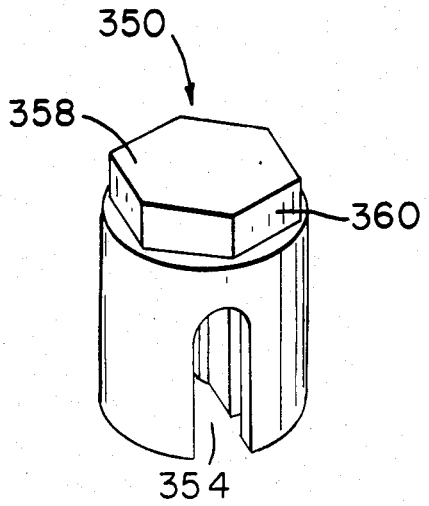
FIG. 8 is a perspective view of the terminating tool.
Figure 9:
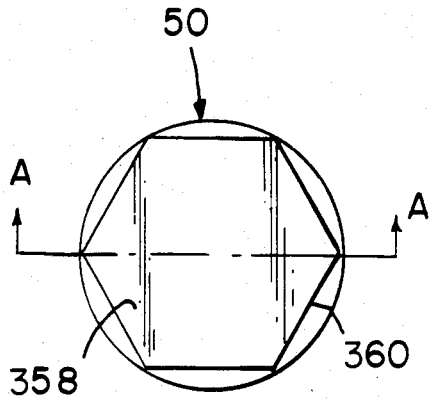
FIG. 9 is a top view of the terminating tool.
Figure 10:
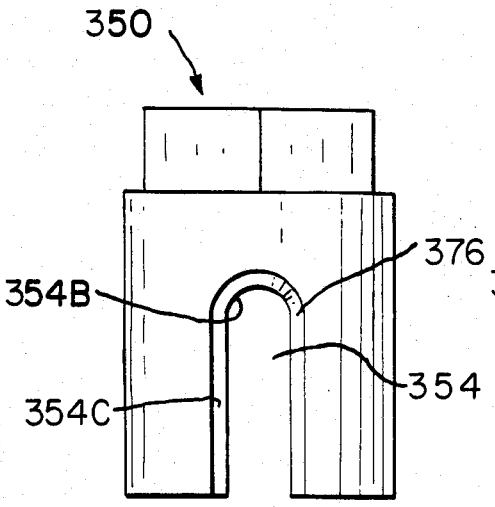
FIG. 10 is a side view of the terminating tool.
Figure 11:
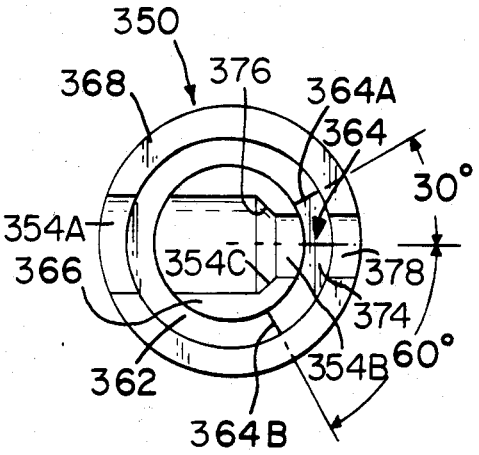
FIG. 11 is a bottom view of the terminating tool.
Figures 12A, 12B:
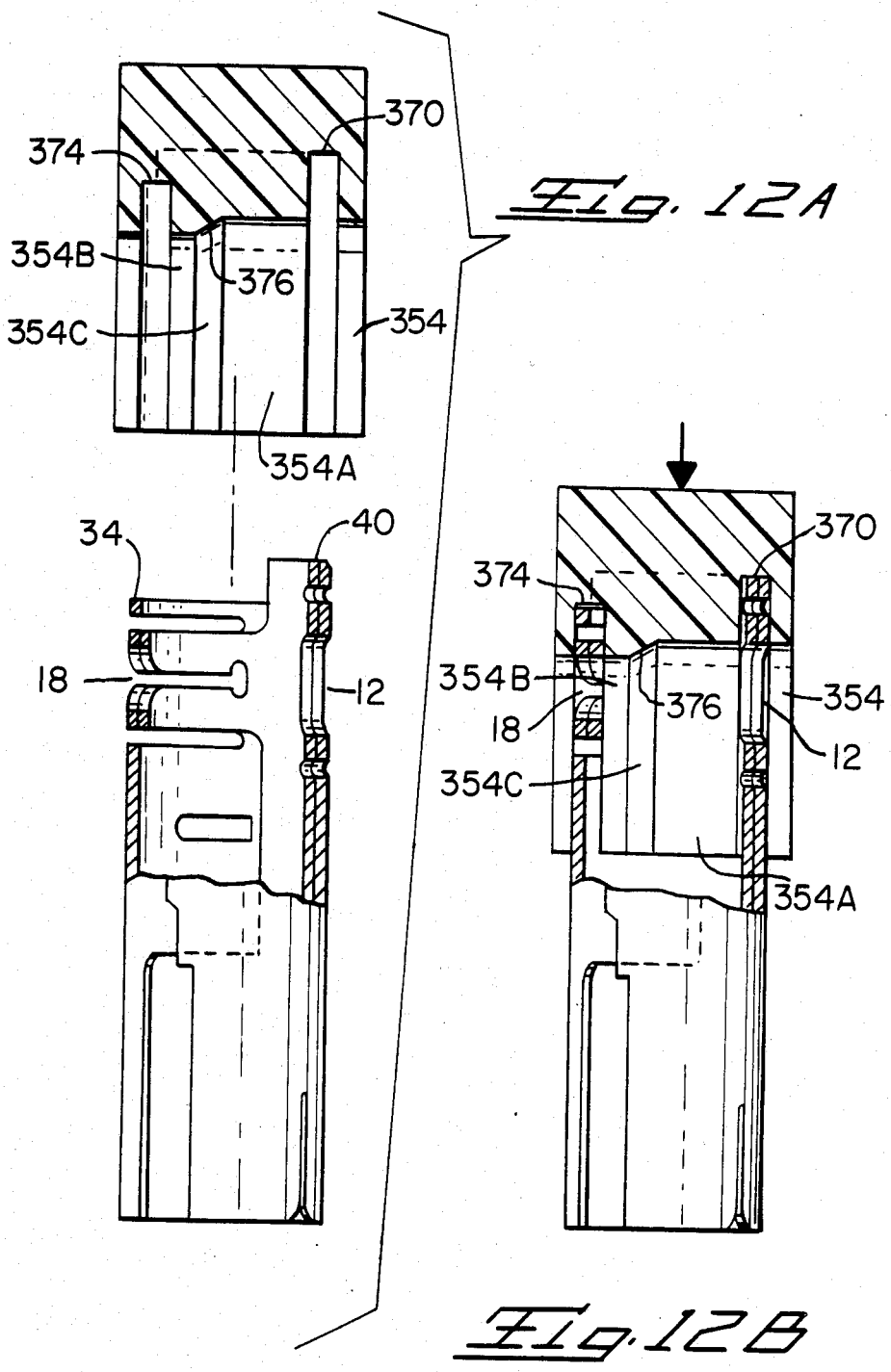
FIG. 12A shows a cross-sectional view of the terminating tool taken through lines A—A of FIG. 9 and a cross-sectional view of the terminal through lines D—D of FIG. 5.
FIG. 12B shows the cross sections of FIG. 12A in a mated relationship.

The terminating tool 350, as shown in FIGS. 8–11, is molded from a dielectric material and includes an outer wall 368 and an inner wall 366 interconnected by a top wall 358; the inner and outer wall defining an inner circular channel 362. As shown in FIG. 11, the tool 350 further comprises rotational lug 364 having surfaces 364A and 364B, and small wire exit channel 378. As shown in FIG. 8, the tool 350 includes hexagonal nut portion 360, and wire entry hole 354. As shown in FIG. 12A, wire entry 354 has large wire entry portion 354A, small wire entry portion 354B, 354A and 354B being connected by a conical transition section 354C, being defined by surface 376. As shown in FIGS. 11 and 12A, bearing surface 374 is the lower surface of rotational lug 364 whereas bearing surface 370 is the upper surface of inner channel 362. As best shown in FIGS. 11–16, small wire exit channel 378 in tool 350 has a side wall 380, and section 354A of wire entry 354 has a side wall 355.

Referring now to the tool 350 as shown in FIG. 11, it is seen that inner circular wall 366 and outer circular wall 368 define inner channel 362, which is so dimensioned as to be slidably received over terminal 10; that is, the outer diameter of inner wall 366 is less than the inner diameter of terminal 10, while the inner diameter of outer wall 368 is greater than the outer diameter of terminal 10. When tool 350 is received over terminal 10, wire receiving opening 354 in tool 350 is aligned with large wire receiving opening 12 and opposed small wire receiving opening 18 in terminal 10. Completely rotating tool 350 clockwise aligns wire receiving hole 354 in tool 350 with the large wire receiving slot 14 and diametrically opposed small wire receiving slot 20.

Figure 6:
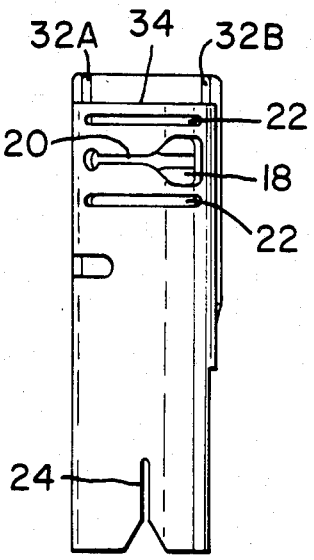
FIG. 6 is a back view of the barrel insulation displacement terminal.

When the tool 350 is received over terminal 10, surface 370 of tool 350 bears on surface 40 of terminal 10 whereas surface 374 of tool 350 bears on surface 34 of terminal 10, as shown in FIGS. 12A and 12B. Although the tool 350 and terminal 10 are rotatable with respect to one another, the angle through which the tool 350 may rotate is fixed, because as best shown in FIGS. 5 and 6, the terminal has rotational stops 32A and 32B, and the tool in turn, as shown in FIG. 11, has a rotational stop lug 364, having surfaces 364A and 364B. When the tool 350 is placed over terminal 10 such that the wire opening hole 354 in the tool 350 aligns with wire opening holes 12 and 18, surface 364B of lug 364 is against surface 32B of terminal 10, and when the tool 350 is rotated, the rotation is limited by surface 364A of lug 364 against surface 32A of terminal 10. Thus, the angle of rotation is defined by the angle of surface 34 as defined by surfaces 32A and 32B, less the included angle of lug 364, as defined by surfaces 364A and 364B, and is the angle required to terminate either the small wire or the large wire in the upper insulation displacement portion 8.

Wire entry 354 in tool 350 receives either the large wire or the small wire, depending on which conductor is to be terminated. As best shown in FIGS. 12A and 12B, entry 354 extends radially through the center of cap 10, and communicates with wire opening holes 12 and 18 in terminal 10, and with small wire exit channel 378. As best seen in FIG. 12A, entry 354 comprises a large wire section 354A, a small wire section 354B and a conical transition section 354C defined by surface 376. Hole 354 will receive either a large diameter wire or a small diameter wire and the large wire will be terminated within slot 14, whereas the small wire would be terminated within slot 20.

Figure 7A:
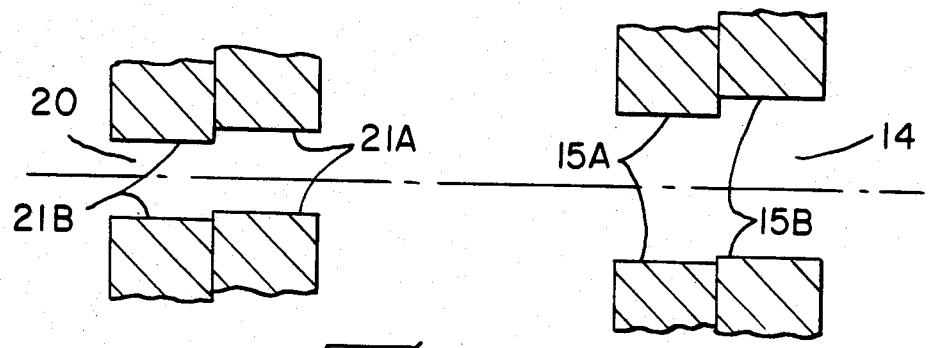
FIG. 7A is a diagrammatical sketch through the axial centerline of the large and small wire-terminating slots.

Termination of either large or small wire produces a spring loaded contact between the conductor and the inner and outer wire receiving slots. As best shown in FIG. 7A, the wire receiving slots, although aligned, are slightly offset vertically. Therefore, the movement of the inner wire receiving slots with respect to the outer wire receiving slots is a coil spring effect, as the blank 2 is a double rolled spiral. When a wire is terminated within a wire receiving slot, the conductor axially realigns the inner and outer wire receiving slots and the conductor is spring loaded within the slot. Therefore, termination of either the large or small wire also produces a redundant three-point interconnection between the conductor of the wire with the wire receiving slots 14, 20. Because the small wire receiving slot 20 has overlapping inner and outer slots 20A and 20B respectively, the conductor of a small wire terminated within small wire receiving opening 20, is terminated within two slots. As best shown in FIG. 3, slot 20A is defined by sheared edges 21A, while slot 20B is defined by sheared edges 21B, and the width of slot 20A is slightly larger than the width of slot 20B, whereas inner 14A and outer 14B slots are defined by sheared edges 15A and 15B, respectively, and inner slot 14A is slightly smaller in width than outer slot 14B, as best shown in FIG. 7A.

Figure 7B:
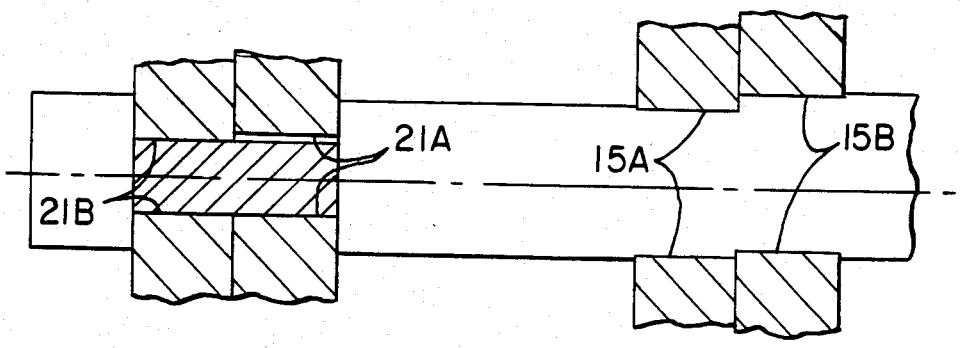
FIG. 7B is a view similar to that of FIG. 7A showing a small wire terminated within the small wire-terminating slot.
Figure 7C:
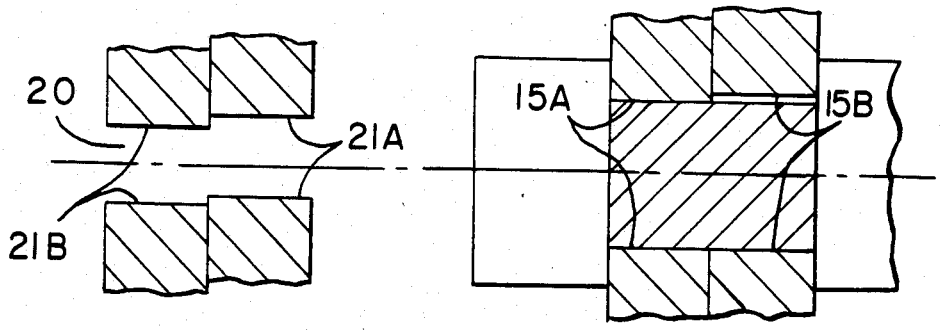
FIG. 7C is a view similar to that of FIG. 7A showing a large wire terminated with the large wire-terminating slot.
Figure 13:
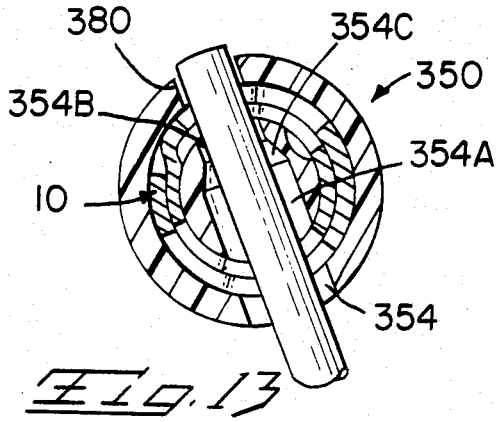
FIG. 13 shows a cross-sectional view of a small wire inserted into the tool and terminal prior to termination.
Figure 14:
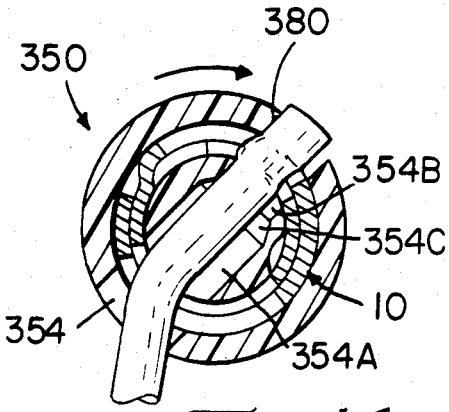
FIG. 14 shows a cross-sectional view of the small wire within the tool and terminal after termination.
Figure 15:
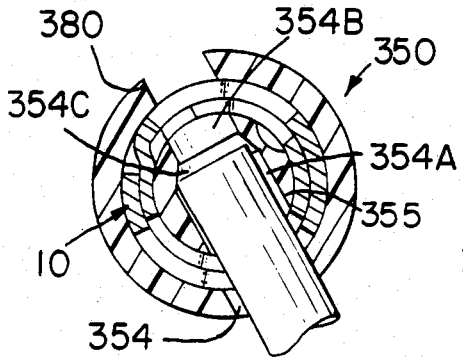
FIG. 15 shows a cross-sectional view of a large wire inserted into the tool and terminal prior to termination.
Figure 16:
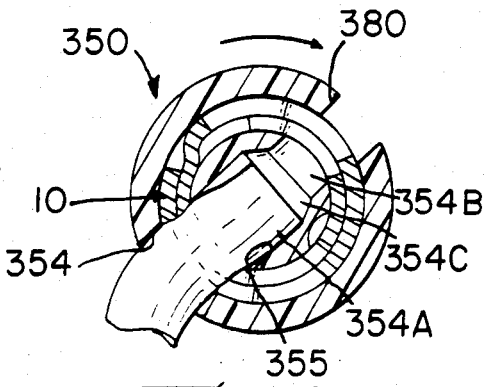
FIG. 16 shows a cross-sectional view of the large wire within the tool and terminal after termination.

Prior to termination of either the large or small wire, the tool 350 is placed over the terminal 10, aligning the wire entry 354 with the large wire opening 12. If a small wire is to be terminated in slot 20, the small wire is placed in entry 354 and extends through sections 354A, 354B and 354C and through exit channel 378, as shown in FIG. 13. When the tool is rotated relative to the terminal, the wire is carried in the channel and side wall 380 of channel 378 forces the conductor into the small wire terminating slot 20, as shown in FIG. 14, and the small wire makes electrical and mechanical contact with sheared surfaces 21A and 21B at three points, because the width of inner slot 14A is slightly larger than the diameter of the small wire conductor, as best shown in FIG. 7B. The small wire is also rotated into slot 14, and the insulation of the small wire is gripped by slot 14, which acts as a strain relief. Conversely, when a large wire is placed in entry 354, the large wire is precluded from entering section 354B, but remains in section 354C, bearing against surface 376 of section 354C, as shown in FIG. 15. When the cap is rotated relative to the terminal, the large wire is carried within entry 354 and surface 355 forces the large wire into the large wire receiving slot 14, as shown in FIG. 16, and the large wire makes electrical and mechanical contact with sheared surfaces 15A and 15B at three points, because the width of outer slot 14B is slightly larger than the diameter of the large wire conductor, as best shown in FIG. 7C.

Both the large and the small wire receiving slots 14 and 20, respectively, have strain relief slots 16 and 22 both above and below the respective receiving slot. As the wire is terminated in the wire receiving slot, stress is accumulated in the end of the wire receiving slot and the strain relief slots relieve the stress and thereby preclude a crack in the wire receiving slot.

Terminating a wire in the large or small wire receiving slot could also cause a turning of the terminal within the array. Therefore an antirotation slot 26 fits into an antirotation peg (not shown) within the array such that any torsion applied to the terminal is applied to the array preventing the terminal from turning.

What is claimed is:

1. A wire-in-slot connecting device of the type comprising a sheet metal tubular body rolled from a flat sheet metal blank, wire admitting opening means in the tubular body proximate to one end thereof and a wire receiving and contacting slot means extending from the opening means partially around the circumference of the body, the connecting device being characterized in that;

the tubular body is of double thickness material around at least a portion of its circumference and comprises an inner layer and an outer layer, the wire admitting opening means comprises a first opening in the outer layer and a second opening in the inner layer, the wire receiving slot means comprising a first slot in the outer layer and a second slot in the inner layer, the first and second openings and the first and second slots being in substantial registry whereby, a wire in the wire receiving slot means is contacted by the edges of the first slow and the edges of the second slot.

2. A wire-in-slot connecting device as set forth in claim 1 characterized in that the first opening and slot are offset from the second opening and slot in the direction of the longitudinal axis of the tubular body whereby upon relative movement of a wire into the slot means the inner layer and the outer layer are resiliently deflected in the direction of the axis of the body and stored energy contact forces are imposed on the wire by the resiliently deflected wire layers.

3. An electrical connecting device comprising:

a spiraled cylinder of stamped and formed conductive material having a continuous first and second layer, at lest one wire admitting opening in transition with a wire-receiving slot, the opening and slot being in adjacent walls of the first and second layers, respectively, whereby inserting a wire into the wire admitting opening and then rotating the wire relative to the terminal, terminates the conductor of the wire in the wire-receiving slot.

4. The device of claim 3 comprising first and second wire admitting openings and wire-receiving slots in opposed relationship.

5. The device of claim 3 comprising first and second slots having wire admitting openings and wire-receiving slots for different gauges of wire.

6. The device of claim 3 further comprising a second wire admitting opening in transition with a wire-receiving slot, the second opening and slot being in adjacent walls of the first and second layers respectively.

7. The device of claim 6 comprising termination means for terminating a connected wire.

8. The device of claim 6 wherein the first and second layers are also spiraled axially such that the adjacent wire receiving slots in the first and second layers are axially offset.

* * * * *